US006931991B1

(12) United States Patent
Cheng et al.

(10) Patent No.: US 6,931,991 B1
(45) Date of Patent: Aug. 23, 2005

(54) SYSTEM FOR AND METHOD OF MANUFACTURING GRAVURE PRINTING PLATES

(75) Inventors: Chen-Hsiung Cheng, Westford, MA (US); Xinbing Liu, Acton, MA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/814,934

(22) Filed: Mar. 31, 2004

(51) Int. Cl.[7] ..... B41N 6/06

(52) U.S. Cl. ..... 101/401.1; 101/375; 101/483; 358/3.31

(58) Field of Search ..... 101/401.1, 375; 347/225, 255; 372/7, 9, 10, 11, 18, 25, 26, 372/29.014, 57; 358/3.31

(56) References Cited

U.S. PATENT DOCUMENTS 3,636,251 A * 1/1972 Daly et al. ..... 358/3.31
5,311,360 A * 5/1994 Bloom et al. ..... 359/572
6,080,529 A 6/2000 Ye et al.
6,146,715 A 11/2000 Kim et al.
6,518,191 B2 2/2003 Nakagawa
6,630,407 B2 10/2003 Keil et al.
6,631,676 B2 * 10/2003 Weichmann et al. ..... 101/170
6,684,783 B2 * 2/2004 Salvestro ..... 101/401.1
6,778,565 B2 * 8/2004 Spuehler et al. ..... 372/25
2003/0022107 A1 1/2003 Yang et al.
2003/0118060 A1 * 6/2003 Spuehler et al. ..... 372/18

* cited by examiner

*Primary Examiner*—Eugene H. Eickholt
(74) *Attorney, Agent, or Firm*—Harness, Dickey & Pierce, PLC

(57) ABSTRACT

A method of operating a laser drilling system to manufacture gravure printing plates without etching or the use of hazardous chemicals includes activating a laser drilling system, including a picosecond laser, light valves, and a mechanism adapted to rotate a gravure cylinder blank. Operation of the light valves, includes setting the light valves to block and/or allow pulses of laser energy propagating from the laser drilling system that can ablate a linear pattern of cells along a substantially entire length of the gravure cylinder blank. Drilling of cells includes targeting the laser drilling system on the gravure cylinder blank, such that ablation of materials occurs as sub-beams propagate along an optical path to the target area and impinge upon the gravure cylinder blank, wherein specific cells within the target area of the gravure cylinder blank are drilled or not drilled according to settings of the light valves.

9 Claims, 5 Drawing Sheets

SYSTEM FOR AND METHOD OF MANUFACTURING GRAVURE PRINTING PLATES

FIELD OF THE INVENTION

The present invention relates to an improved method of producing gravure printing plates.

BACKGROUND OF THE INVENTION

Of the many printing methods that are currently in use, the four methods most prevalent today are letterpress, flexography, gravure, and offset lithography, or offset printing. The total worldwide market for the printing industry is currently estimated to be $420 billion, with offset and gravure printing comprising the majority of that market with approximately 47% and 20% of the total volume, respectively.

Gravure is an intaglio printing process. The printer's image carrier is commonly called a "printing plate"; however, it is most typically a hollow metal cylinder covered with many tiny indentations known as "cells" that transmit the printed image. During printing, the image carrier is immersed in fluid ink. As the image carrier rotates, ink fills the etched cells that cover the surface of the cylinder. The surface of the cylinder is then wiped with a squeegee known as a "doctor blade" that leaves the non-image area clean while retaining the ink in the recessed cells. During the process of printing, paper is brought into contact with the image carrier with the help of an impression roll that applies pressure. At the point of contact, ink is drawn out of the cells of the image carrier onto the paper by capillary action.

Gravure is a large-volume printing method. The high costs of cylinders generally limit gravure printing to run lengths of over 1 million impressions. Gravure presses are also much wider, and therefore more expensive, than other printing press types. Unlike the inks used in letterpress or offset printing, the ink used in gravure printing is very fluid and is usually solvent-based; as a result, the ink is an environmental hazard. In addition, the method of cutting cells into the image carrier is typically a photolithographic process in which the cell patterns are etched into a copper-clad image carrier using highly corrosive and toxic chemicals. What is needed is a lower-cost method of producing gravure image carriers that reduces or eliminates the environmental and human risks associated with the current methods that use chemical etching.

An example of an improved method of producing gravure image carriers is described in U.S. Pat. No. 4,405,709, "Process for fabricating gravure printing plate blank." The '709 patent describes a reusable gravure cylinder blank that can be readily processed into an image carrier. The blank includes a non-etchable and wear-resistant layer of chromium that overlays the surface of the cylinder. In addition, multiple dot-like "etchable" portions of copper, of equal size and uniform placement, are also located on the surface of the cylinder. The copper dots are isolated from each other by the non-etchable chromium. The gravure printing image carrier or printing cylinder is produced from this blank by a selective etching process that removes some of the etchable copper dots. In this way, the use of copper and, therefore, the costs of producing an image carrier are reduced. In addition, the use of toxic etching chemicals is greatly reduced, in comparison with standard techniques.

Although the method of the '709 patent reduces costs by reducing the etching of copper, it does not eliminate the etching of copper and other expensive materials. In addition, the use of chemical etching agents is reduced, but not eliminated. What is needed is means of producing a gravure printing cylinder that does not rely on etching and does not use hazardous chemicals. The present invention fulfills this need.

SUMMARY OF THE INVENTION

In accordance with the present invention, a method of operating a laser drilling system to manufacture gravure printing plates without etching or the use of hazardous chemicals includes activating a laser drilling system, including a picosecond laser, light valves, and a mechanism adapted to rotate a gravure cylinder blank. Operation of the light valves, includes setting the light valves to block and/or allow pulses of laser energy propagating from the laser drilling system that can ablate a linear pattern of cells along a substantially entire length of the gravure cylinder blank. Drilling of cells includes targeting the laser drilling system on the gravure cylinder blank, such that ablation of materials occurs as sub-beams propagate along an optical path to the target area and impinge upon the gravure cylinder blank, wherein specific cells within the target area of the gravure cylinder blank are drilled or not drilled according to settings of the light valves.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The present invention is a method of and an apparatus for laser drilling a gravure cylinder blank to create precise cells in order to produce a low-cost gravure image carrier with high resolution. Moreover, the present invention provides a gravure cylinder blank that is directly cut without chemical etching, thereby eliminating the use of hazardous materials typically used to produce a gravure printing cylinder.

Figure 1:
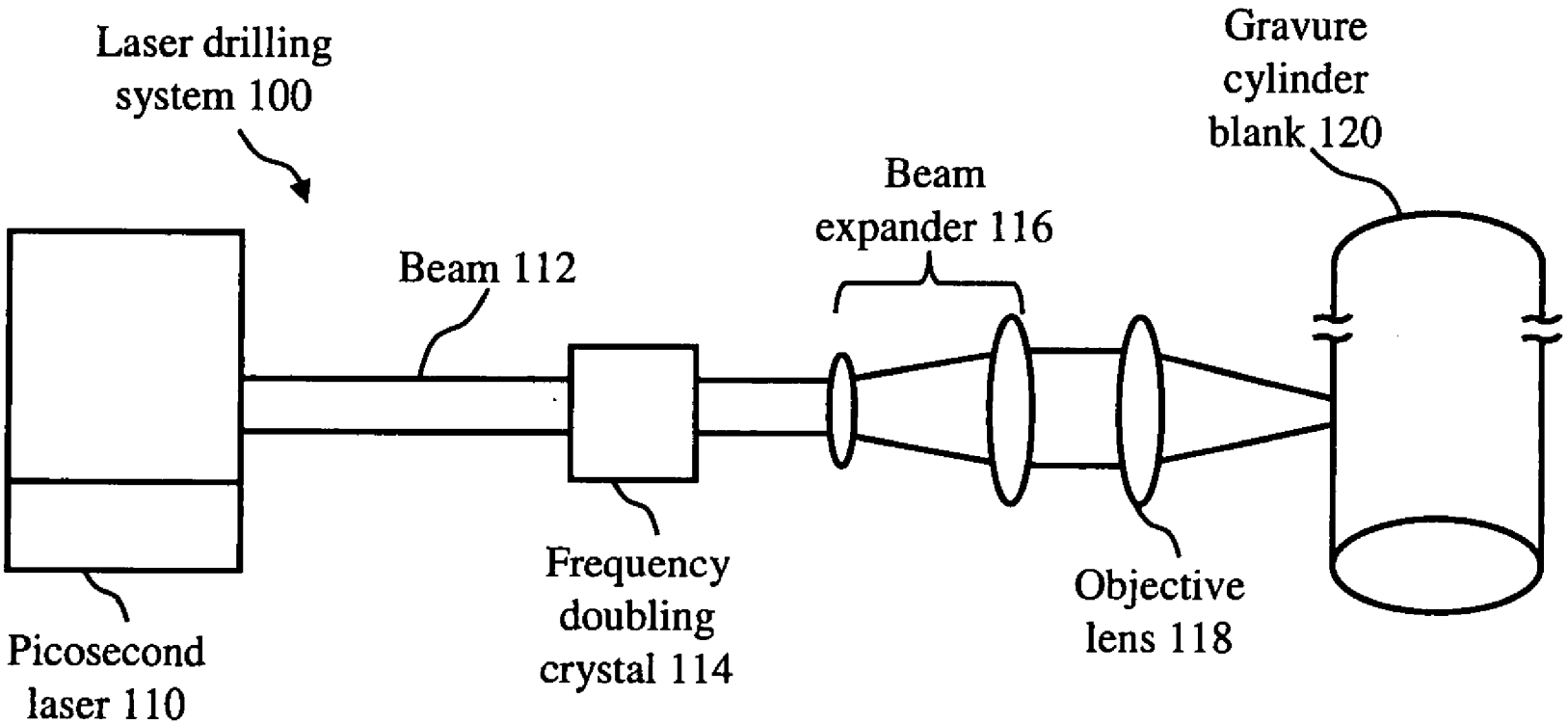
FIG. 1 illustrates a single cell laser drilling system.

FIG. 1 illustrates a laser drilling system 100 suitable for creating a single cell at a time in a gravure cylinder blank. Laser drilling system 100 includes a picosecond laser 110, a beam 112, a frequency doubling crystal 114, a beam expander 116, an objective lens 118, and a gravure cylinder blank 120.

Picosecond laser 110 and frequency doubling crystal provide sufficient pulse energy to ablate material in gravure cylinder blank 120, for example, a few to a few hundred microjoules. Pulse width is longer than a few picoseconds and less than 1000 picoseconds. Bandwidth of the picosecond laser 110 is no more than 50% higher than the transform limit of a given pulse width to provide good beam splitting. Pulse repetition rate is between 50-Hz to 1-MHz to be practical. Picosecond laser 110 emits beam 112, which in this example has a wavelength of 1.053 micron. The frequency doubling crystal convert majority of the 1.053-micron beam to 526-nm beam.

Frequency doubling crystal 114 halves the wavelength of beam 112, in this example, producing a beam 112 with a wavelength of 526 nanometers. Beam expander 116 is a series of lenses that expands beam 112 by, for example, three times, from 1.5-mm in diameter to 4.5-mm in diameter. Objective lens 118 focuses beam 112 on gravure cylinder blank 120, in this example, to 3 microns. Gravure cylinder blank 120 is the target for laser drilling system 100. In one example, gravure cylinder blank 120 is a hollow steel cylinder that is copper- or nickel-plated.

In operation, picosecond laser 110 emits beam 112 along the optical path identified in FIG. 1. Beam 112 propagates along the optical path, where it is incident upon frequency doubling crystal 114. Frequency doubling crystal 114 halves the wavelength of beam 112 and redirects beam 112 along the optical path, where it is incident upon beam expander 116. Beam expander 116 increases the size of beam 112 by, for example, three times. Subsequently, objective lens 118 focuses beam 112, which ablates a hole of approximately 3 microns on gravure cylinder blank 120. The combination of shorter wavelength and expanded beam size before being focused by the objective lens 118 makes the focus small enough for precise ablation of small cell.

The use of a short-pulse (picosecond) laser source in the present invention minimizes excess thermal effects that lead to misshapen and distorted cell shapes. Although laser drilling system 100 is capable of drilling a cell on gravure cylinder blank 120, its practical use is severely limited, as it only ablates a single cell at a time.

Figure 2:
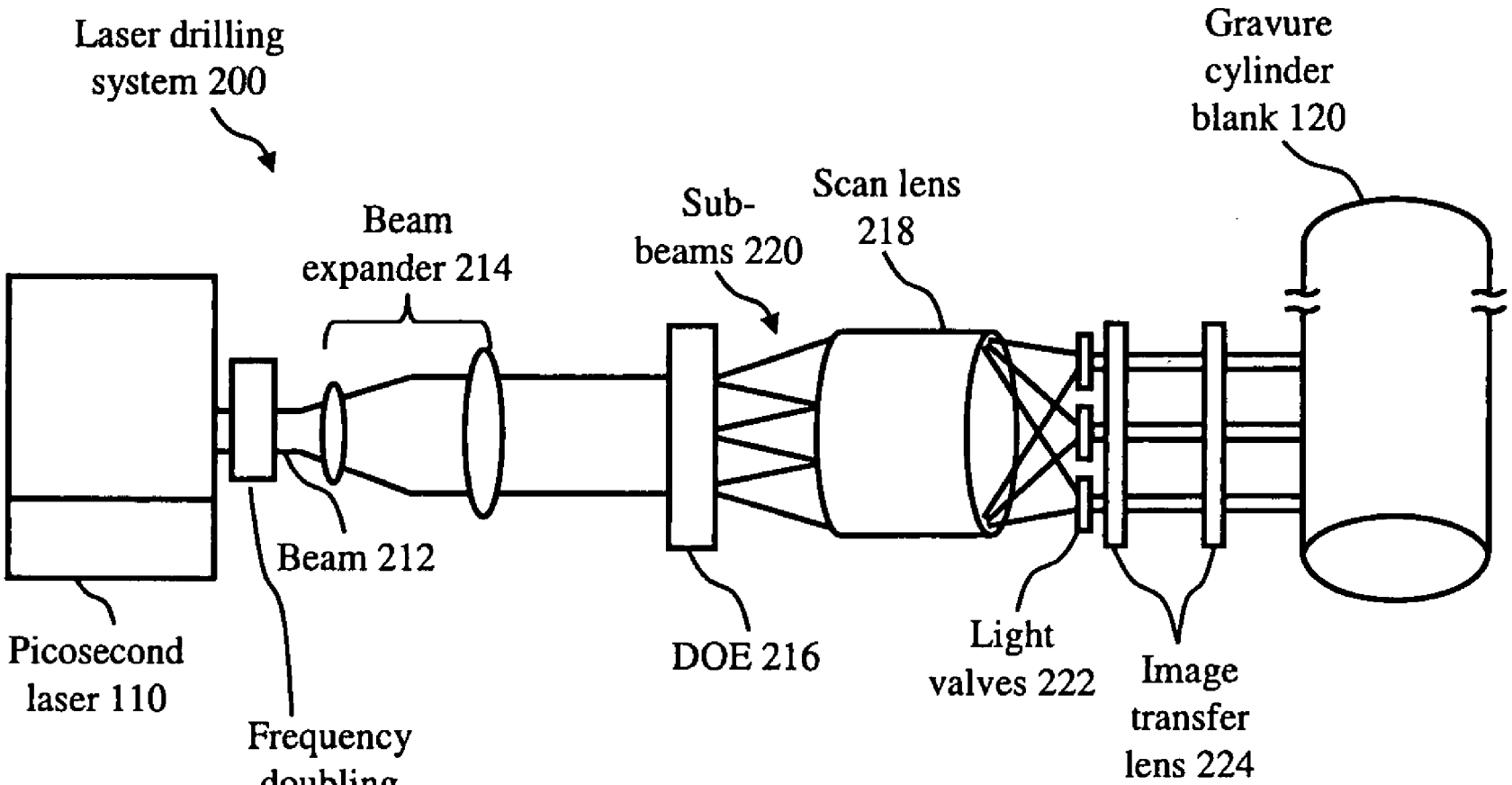
FIG. 2 illustrates a short linear cell array laser drilling system.

FIG. 2 illustrates a laser drilling system 200 containing a single diffractive optical element capable of drilling a short linear array of cells, for example, several cells along the length of gravure cylinder blank 120, at a single time. Laser drilling system 200 includes picosecond laser 110, a beam 212, a beam expander 214, a diffractive optical element (DOE) 216, a scan lens 218, a plurality of sub-beams 220, a plurality of light valves 222, an image transfer lens 224, and gravure cylinder blank 120.

Picosecond laser 110 and frequency doubling crystal provide sufficient pulse energy to ablate material in gravure cylinder blank 120, for example, a few hundred microjoules to a few tens millijoules. Pulse width is longer than a few picoseconds and less than 1000 picoseconds. Bandwidth of the picosecond laser 110 is no more than 50% higher than the transform limit of a given pulse width to provide good beam splitting. Pulse repetition rate is between 50-Hz to 1-MHz to be practical. Picosecond laser 110 emits beam 212, which in this example has a wavelength of 1.053 micron. The frequency doubling crystal convert majority of the 1.053-micron beam to 526-nm beam.

Beam expander 214 is a series of lenses used in the present invention to match the size of beam 212 to the pupil size of scan lens 218 to achieve the smallest possible focus size. The specifications of beam expander 214 are selected in coordination with the specifications of the size of beam 212 from frequency doubling crystal 114 and the specifications of scan lens 218. When exiting beam expander 214, beam 212 should be the same size or slightly smaller than the pupil size of scan lens 218. One example of beam expander 214 is a pair of negative and positive lenses, the negative lens having a focal length of −24.9 mm and the positive lens having a focal length of 143.2 mm.

DOE 216 acts as a highly efficient beamsplitter and beam array pattern generator that allows laser drilling system 200 to drill multiple cells on gravure cylinder blank 120. In the example shown in FIG. 2, DOE 216 splits the single incident laser beam 212 from frequency doubling crystal 114 into only three sub-beams 220 in order to simplify the illustration. The pattern of sub-beams 220 output by DOE 216 is the pre-determined pattern of cells to be drilled on gravure cylinder blank 120. In an alternate embodiment, an excimer laser with a kinoform could be used. However, this is an impractical solution for precision drilling due to the poor beam quality and bandwidth of excimer lasers.

In the present invention, scan lens 218 is an f-theta telecentric (scan) lens. Scan lens 218 determines the size of sub-beams 220 impinging upon on gravure cylinder blank 120. The size of sub-beams 220 that enters scan lens 218 must be less than or equal to the pupil size of scan lens 218. Telecentricity is required to keep the incident angle between sub-beams 220 and gravure cylinder blank 120 perpendicular, which is necessary for the holes drilled in gravure cylinder blank 120 to be parallel.

Light valves 222, in the present invention, are conventional mechanical valves or a micro-electrical-mechanical system (MEMS). The purpose of light valves 222 is to allow sub-beams 220 to illuminate gravure cylinder blank 120 when light valves 222 are in the open state, and to prevent sub-beams 220 from illuminating gravure cylinder blank 120 when light valves 222 are in the closed state.

Image transfer lens 224 maintains image quality, beam size, and telecentricity, while protecting light valves 222 against blowback of particles ablated from gravure cylinder blank 120 by distancing gravure cylinder blank 120 from light valves 222. To clearly separate the subbeams, the light valves have to placed near the focus where the beam diameter is small. The ablated particles may damage light valves 222. In one example, image transfer lens 224 consists of two telecentric scan lenses identical to scan lens 218, placed back to back, with the pupil planes of the two scan lenses coinciding in the center.

Gravure cylinder blank 120 is the target for laser drilling system 200. In one example, gravure cylinder blank 120 is a hollow steel cylinder that is copper- or nickel-plated; however, the present invention may be generalized to a variety of cylinder materials, such as chromium, polymers, or other materials. In alternate embodiments, laser drilling system 200 can drill holes of a wide variety of shapes and sizes in gravure cylinder blank 120.

In operation, picosecond laser 110 and frequency doubling crystal 114 emit beam 212 along the optical path identified in FIG. 2. Beam 212 propagates along the optical path, where it is incident upon beam expander 214. Beam expander 214 increases the size of beam 212 by, for example, six times, for two reasons. First, beam 212 must be big enough to cover several periods of DOE 216 so that DOE 216 may function correctly as a beamsplitter. Second, sub-beams 220 must be big enough to match the pupil size of scan lens 218.

Upon exiting beam expander 214, beam 212 travels along the optical path, where it is incident upon DOE 216. DOE 216 splits beam 212 into a plurality of sub-beams 220 that allow the drilling of a linear series of cells on gravure cylinder blank 120. Sub-beams 220 exit DOE 216 and propagate along the optical path, where they are incident upon scan lens 218. Scan lens 218 determines the spot size of sub-beams 220 upon gravure cylinder blank 120. Sub-beams 220 exit scan lens 218 and propagate along the optical path, where they are incident upon light valves 222. Light valves 222 are individually opened and closed by a control algorithm resident on a central computer (not shown) to enable a pattern of cells to be cut on gravure cylinder blank 120 such that a printed image can be produced. Sub-beams 220 exit light valves 222 and propagate along the optical path, where they focus upon image transfer lens 224. Image transfer lens 224 re-images the focal spots of sub-beams 220 onto gravure cylinder blank 120. Sub-beams 220 ablate the material of gravure cylinder blank 120 in a pattern according to the pre-defined milling algorithm. In the present embodiment, the image magnification ratio is 1; however, other image magnification ratios may be used in alternate embodiments.

In an alternative embodiment, sub-beams 220 exit light valves 222 and are incident upon image transfer lens 224, but are not focused there. In this alternative embodiment, sub-beams 220 are focused after exiting image transfer lens 224 by, for example, an additional objective lenses (not shown).

The use of a short-pulse (picosecond) laser source in the present invention minimizes excess thermal effects that lead to misshapen and distorted cell shapes. Although laser drilling system 200 is capable of drilling an array of cells on gravure cylinder blank 120, its practical use is limited due to the limited width of the array of cells that can be produced by a single scan lens.

Figure 3:
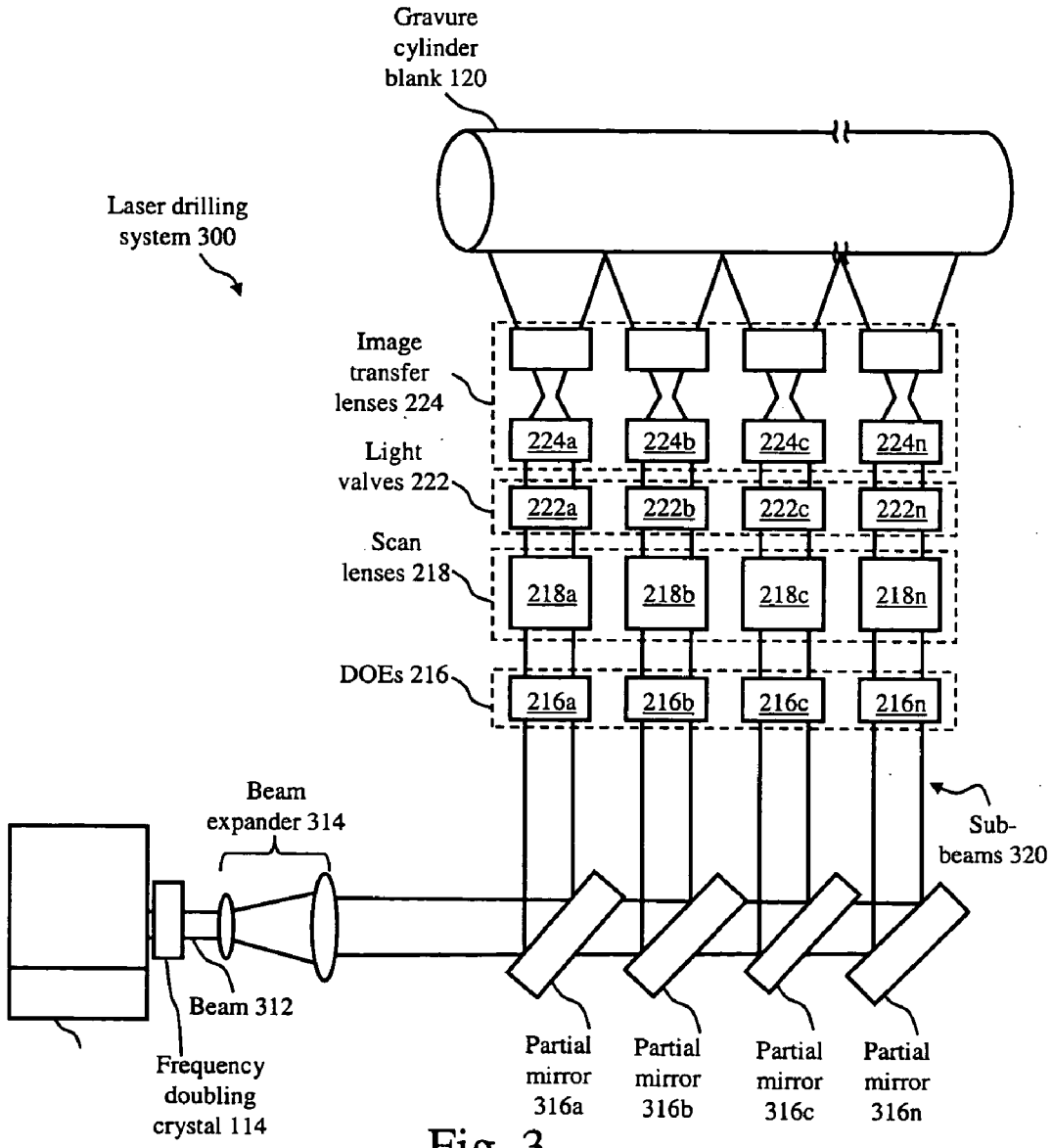
FIG. 3 illustrates a long linear cell array laser drilling system.

FIG. 3 illustrates a laser drilling system 300 containing multiple diffractive optical elements capable of drilling a long linear array of cells, for example, on the entire length of gravure cylinder blank 120, at a single time. Laser drilling system 300 includes picosecond laser 110; a frequency doubling crystal 114; a beam 312; a beam expander 314; a plurality of partial mirrors 316, i.e., partial mirror 316*a* to partial mirror 316*n* (where n represents an indefinite number); a plurality of DOEs 216*a* to 216*n*; a plurality of scan lenses 218*a* to 218*n*; a plurality of light valves 222*a* to 222*n*; a plurality of image transfer lenses 224*a* to 224*n*; a plurality of sub-beams 320*a* to 320*n*; and gravure cylinder blank 120.

Picosecond laser 110 and frequency doubling crystal provide sufficient pulse energy to ablate material in gravure cylinder blank 120, for example, a few millijoules to a few hundred millijoules. Pulse width is longer than a few picoseconds and less than 1000 picoseconds. Bandwidth of the picosecond laser 110 is no more than 50% higher than the transform limit of a given pulse width to provide good beam splitting. Pulse repetition rate is between 50-Hz to 1-MHz to be practical. Picosecond laser 110 emits beam 312, which in this example has a wavelength of 1.053 micron. The frequency doubling crystal convert majority of the 1.053-micron beam to 526-nm beam.

Beam expander 314 is used in the present invention to match the size of beam 312 to the pupil size of scan lenses 218. The specifications of beam expander 314 are selected in coordination with the specifications of the size of beam 312 from frequency doubling crystal 114 and scan lenses 218. When exiting beam expander 314, beam 312 should be the same size or slightly smaller than the pupil size of scan lenses 218. One example of beam expander 214 is a pair of negative and positive lenses, the negative lens having a focal length of −24.9 mm and the positive lens having a focal length of 143.2 mm.

Partial mirrors 316 are partially reflective with appropriate reflectivity to split the beam strength evenly. They are arranged so that beam 312 is split into sub-beams 320 as shown in FIG. 3 and so that each sub-beam 320 is reflected to an associated DOE 216. Each DOE 216 simultaneously divides its sub-beam 320 into a linear sequence of laser light dots that together cover the entire axial length of gravure cylinder blank 120. In an alternate embodiment, an excimer laser with a kinoform could be used. However, this is an impractical solution for precision drilling due to the poor beam quality of excimer lasers.

Scan lenses 218, light valves 222, and image transfer lenses 224 are as described in reference to FIG. 2, with the exception that these elements manipulate sub-beams 320 instead of sub-beams 220. The purpose of light valves 222 in this configuration is to allow the selective illumination of laser light dots on gravure cylinder blank 120 so that multiple cells can be drilled in a specific linear pattern on gravure cylinder blank 120.

In operation, picosecond laser 110 and frequency doubling crystal 114 emit beam 312 along the optical path identified in FIG. 3. Beam 312 propagates along the optical path, where it is incident upon beam expander 314. Beam expander 314 increases the size of beam 312 several times for two reasons. First, beam 312 must be big enough to cover several periods of DOEs 216 so that DOEs 216 may function correctly as beamsplitters. Second, sub-beams 320 must be big enough to match the pupil size of scan lenses 218. Beam 312 exits beam expander 314 and propagates along the optical path, where it is incident upon partial mirrors 316.

Partial mirrors 316 are arranged so that beam 312 is split into sub-beams 320 as shown in FIG. 3 and so that each sub-beam 320 is reflected to an associated DOE 216. Each DOE 216 simultaneously divides its sub-beam 320 into a linear series of dots that allow the drilling of a plurality of sequential cells on gravure cylinder blank 120. Sub-beams 320 exit DOEs 216 and propagate along the optical path, where they are incident upon scan lenses 218. Scan lenses 218 determine the dot size of sub-beams 320 upon gravure cylinder blank 120.

Sub-beams 320 exit scan lenses 218 and propagate along the optical path, where they are incident upon light valves 222. Individual light valves 222 are opened or closed by a control algorithm resident on a central computer (not shown) to enable a linear pattern of cells to be cut on the entire length of gravure cylinder blank 120 at a single time. Sub-beams 320 exit light valves 222 and propagate along the optical path to image transfer lenses 224. Image transfer lenses 224 re-image the dots of sub-beams 320 onto gravure cylinder blank 120. Sub-beams 320 ablate the material of gravure cylinder blank 120 in a pattern according to the pre-defined control algorithm. In the present embodiment, the image magnification ratio is 1; however, other image magnification ratios may be used in alternate embodiments. Gravure cylinder blank 120 is sequentially rotated as successive linear cell patterns are drilled until the entire surface of gravure cylinder blank 120 is populated with cells that will form the printed image. The use of a short-pulse (picosecond) laser source in the present invention minimizes excess thermal effects that lead to misshapen and distorted cell shapes.

Figure 4A:
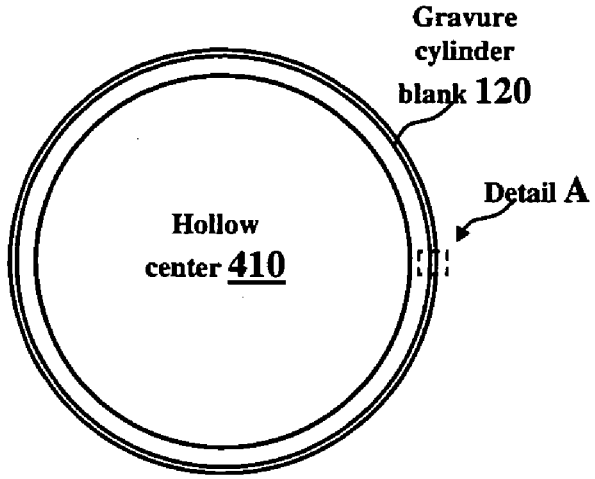
FIGS. 4A through 4D illustrate three different types of gravure cylinder blanks.

FIGS. 4A through 4D illustrate three different types of gravure cylinder blanks 120. FIG. 4A is a cross-sectional view of the structure of typical gravure cylinder blank 120 (as described in reference to FIG. 1), showing a hollow center 410 and the location of a Detail A.

Figure 4B:
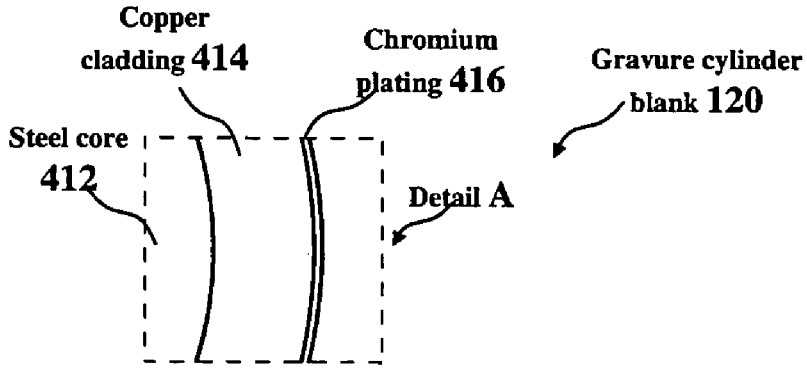

FIG. 4B depicts Detail A for typical gravure cylinder blank 120, which is well known in the industry. A quantity of copper cladding 414 covers a steel core 412, which in turn surrounds hollow center 410. A quantity of chromium plating 416 covers copper cladding 414.

Figure 4C:
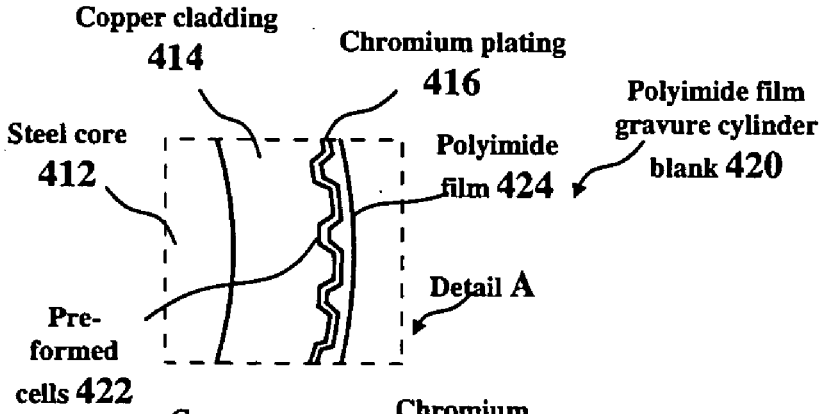

FIG. 4C depicts Detail A for a polyimide film gravure cylinder blank 420 that is well suited for use with the present invention. Polyimide film gravure cylinder blank 420 also possesses chromium plating 416, copper cladding 414, steel core 412, and hollow center 410, as described above. Polyimide film gravure cylinder blank 420 is further covered with a plurality of pre-formed cells 422, for example, cells 3 microns in diameter at a 6-micron pitch. In addition, the entire cylinder is coated with a polyimide film 424 of a regular thickness that completely covers chromium plating 416 and uniformly fills pre-formed cells 422.

Figure 4D:
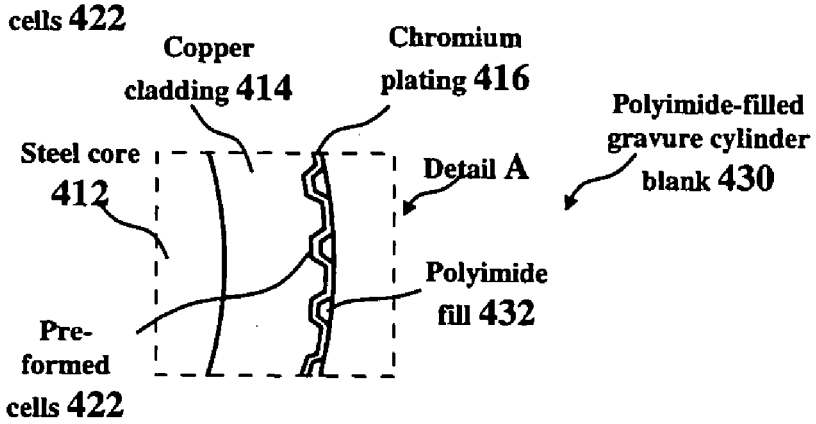

FIG. 4D depicts Detail A for a polyimide-filled gravure cylinder blank 430 that is well suited for use with the present invention. Polyimide-filled gravure cylinder blank 430 also possesses pre-formed cells 422, chromium plating 416, copper cladding 414, steel core 412, and hollow center 410, as described above. Pre-formed cells 422 in polyimide filled gravure cylinder blank 430 are covered with a low-ablation polyimide fill 432 instead of polyimide film 424. However, polyimide fill 432 does not cover the unablated portions of chromium plating 416.

In current practice, gravure cylinder blank 120 is rotated about its axis in small incremental steps, for example, 6-micron steps, and successive linear arrays of cells are formed around its circumference by the operation of laser drilling system 300. In typical gravure cylinder blank 120, each cell is formed as laser drilling system 300 ablates a small portion of chromium plating 416, for example, 3 microns in diameter and 3 microns deep. For polyamide film gravure cylinder blank 420 and polyimide filled gravure cylinder blank 430, chromium plating 416 and copper cladding 414 are not ablated; in both cases, the operation of laser drilling system 300 ablates only the polyamide material in pre-formed cells 422. Ablating this less expensive material instead of the chromium and copper reduces costs in comparison with conventional methods of gravure printing. Polyamide film gravure cylinder blank 420 costs less to produce than polyimide-filled gravure cylinder blank 430.

Figure 5:
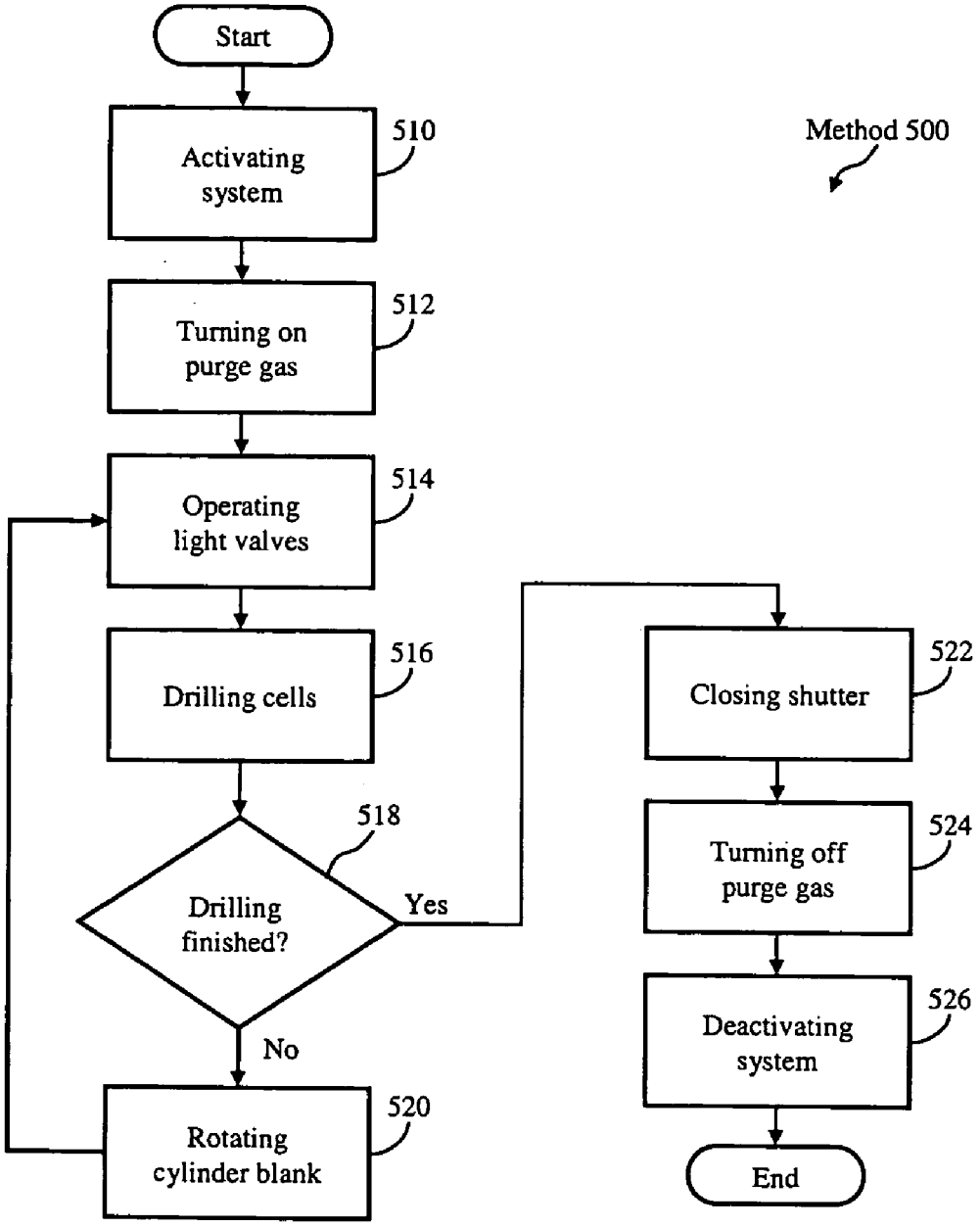
FIG. 5 is a flow diagram of a method of operating the long linear cell array laser drilling system of the present invention.

FIG. 5 illustrates a flow diagram of a method 500 of operating laser drilling system 300 in accordance with the invention. Although method 500 refers to gravure cylinder blank 120 in the present example, polyimide film gravure cylinder blank 420 or polyimide-filled gravure cylinder blank 430 can also be used. Method 500 includes the steps of:

Step 510: Activating System

In this step, upon initially powering up the system, laser drilling system 300 initializes picosecond laser 110, light valves 222, and the mechanism (not shown) that rotates gravure cylinder blank 120, thereby activating laser drilling system 300. Method 500 proceeds to step 512.

Step 512: Turning on Purge Gas

In this step, an operator or automated system opens a gas flow valve (not shown) to purge gravure cylinder blank 120 with a gas in order to remove debris generated during laser ablation from the target area. Method 500 proceeds to step 514.

Step 514: Operating Light Valves

In this step, light valves 222 are set to block or allow pulses of laser energy propagating from laser drilling system 300 that can ablate a linear pattern of cells along the entire length of gravure cylinder blank 120. Method 500 proceeds to step 516.

Step 516: Drilling Cells

In this step, laser drilling system 300 is targeted on gravure cylinder blank 120. Ablation of materials occurs as sub-beams 320 propagate along the optical path to the target area and impinge upon gravure cylinder blank 120. Specific cells within the target area of gravure cylinder blank 120 are drilled or not drilled according to the settings of light valves 222 in step 514. Method 500 proceeds to step 518.

Step 518: Drilling Finished?

In this decision step, a control algorithm resident on a central computer (not shown) determines whether gravure cylinder blank 120 has been rotated around its axis a predetermined number of incremental steps, indicating that the entire surface of gravure cylinder blank 120 is populated with cells. If yes, method 500 proceeds to step 522; if no, method 500 proceeds to step 520.

Step 520: Rotating Cylinder Blank

In this step, gravure cylinder blank 120 is rotated an incremental step of small distance, for example, 6 microns, by the mechanism (not shown) that rotates gravure cylinder blank 120, so that the next linear pattern of cells can be ablated along gravure cylinder blank 120. Method 500 returns to step 514.

Step 522: Closing Shutter

In this step, laser drilling system 300 stops drilling cells. Method 500 proceeds to step 524.

Step 524: Turning Off Purge Gas

In this step, purge gas that removes debris generated during laser ablation is shut off. Method 500 proceeds to step 526.

Step 526: Deactivating System

In this step, laser drilling system 300 is deactivated. Method 500 ends.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of operating a laser drilling system to manufacture gravure printing plates without etching or the use of hazardous chemicals, comprising:

activating a laser drilling system, including a picosecond laser, light valves, and a mechanism adapted to rotate a gravure cylinder blank;

operating the light valves, including setting the light valves to at least one of block and allow pulses of laser energy propagating from the laser drilling system that can ablate a linear pattern of cells along a substantially entire length of the gravure cylinder blank; and drilling cells, including targeting the laser drilling system on the gravure cylinder blank, such that ablation of materials occurs as sub-beams propagate along an optical path to the target area and impinge upon the gravure cylinder blank, wherein specific cells within the target area of the gravure cylinder blank are drilled or not drilled according to settings of the light valves.

2. The method of claim 1, further comprising turning on purge gas before drilling cells, including opening a gas flow valve oriented to purge the gravure cylinder blank with a gas in order to remove debris generated during laser ablation from a target area.

3. The method of claim 1, further comprising deciding whether drilling is finished, including employing a control algorithm resident on a central computer to determine whether the gravure cylinder blank has been rotated around its axis a predetermined number of incremental steps, indicating that a substantially entire surface of gravure cylinder blank is populated with cells.

4. The method of claim 1, further comprising rotating the gravure cylinder blank while drilling is not finished, including rotating the gravure cylinder blank an incremental step of distance by the mechanism adapted to rotate the gravure cylinder blank, thereby aligning the cylinder to accomplish successive ablation of a next linear pattern of cells along the gravure cylinder blank.

5. The method of claim 1, further comprising closing a shutter interposed between a source of the pulses of laser energy and the gravure cylinder blank after drilling is finished, thereby stopping drilling of cells.

6. The method of claim 1, further comprising turning off purge gas after drilling is finished.

7. The method of claim 1, further comprising deactivating the laser drilling system after drilling is finished.

8. The method of claim 1, further comprising employing a polyimide film gravure cylinder blank.

9. The method of claim 1, further comprising employing a polyimide-filled gravure cylinder blank.

* * * * *